United States Patent [19]

Inaba et al.

[11] Patent Number: 4,707,406

[45] Date of Patent: Nov. 17, 1987

[54] THERMAL TRANSFER RECORDING MEDIUM

[75] Inventors: Yoshihiro Inaba; Kunihiro Koshizuka; Tatsuichi Maehashi; Takao Abe, all of Hino, Japan

[73] Assignee: Konishiroku Photo Industry Co., Ltd., Tokyo, Japan

[21] Appl. No.: 815,249

[22] Filed: Dec. 31, 1985

[30] Foreign Application Priority Data

Jan. 12, 1985 [JP] Japan ..... 60-2642
Jan. 12, 1985 [JP] Japan ..... 60-2643
Jan. 22, 1985 [JP] Japan ..... 60-8447

[51] Int. Cl.[4] ..... B41M 5/26

[52] U.S. Cl. ..... 428/336; 428/195; 428/412; 428/423.1; 428/423.7; 428/424.8; 428/425.1; 428/425.8; 428/458; 428/461; 428/463; 428/480; 428/481; 428/483; 428/484; 428/488.1; 428/488.4; 428/500; 428/511; 428/516; 428/518; 428/522; 428/913; 428/914

[58] Field of Search ..... 428/488.1, 488.4, 913, 428/914, 195, 207, 210, 211, 336, 412, 423.1, 423.7, 424.8, 425.1, 425.8, 458, 461, 463, 480, 481, 483, 484, 500, 511, 516, 518, 522

[56] References Cited

FOREIGN PATENT DOCUMENTS 0201690 11/1983 Japan ..... 428/488.4
0165690 9/1984 Japan ..... 428/488.4
0127192 7/1985 Japan ..... 428/488.4

*Primary Examiner*—Bruce H. Ress
*Attorney, Agent, or Firm*—Frishauf, Holtz, Goodman & Woodward

[57] ABSTRACT

A thermal transfer recording medium comprising (i) a support, (ii) a heat-fusible colorant layer and (iii) adhesion layer between said support and said colorant layer; said adhesion layer containing at least one resin selected from the group (A) consisting of a polyurethane resin, a phenoxy resin, a polyester resin and a polycarbonate resin, and at least one copolymer selected from the group (B) consisting of a vinyl acetate copolymer and an acrylate copolymer. According to the medium of this invention, adhesive force between the support and the colorant layer can be consolidated and thus good pattern printing can be obtained without film peel-off for a large number of times even when applied power may be increased.

32 Claims, 4 Drawing Figures

THERMAL TRANSFER RECORDING MEDIUM

BACKGROUND OF THE INVENTION

This invention relates to a thermal transfer recording medium, more particularly to a thermal transfer recording medium which can be prevented from film peel-off of the heat-fusible colorant layer and can be suitably used for printing for multiple times.

In the prior art, as the adhesion layer to be interposed between the support and the heat-fusible colorant layer, it has been disclosed to use polyester resin, vinyl chloride-vinyl acetate copolymer, acrylic resin, vinyl chloride resin (see Japanese Unexamined Patent Publication No. 105579/1980), polyamide resin (see Japanese Unexamined Patent Publication No. 116193/1981), polyvinyl butyral resin, epoxy resin (see Japanese Unexamined Patent Publication No. 36698/1982) and saturated linear polyester resin (see Japanese Unexamined Patent Publication No. 96992/1984).

Since the heat-fusible colorant layer of the prior art employs a compound with relatively smaller polarity such as wax, higher fatty acid, etc. as a main component, when a polymer film with relatively greater polarity such as a polyester resin or a polyamide resin is used for the support, if an adhesive material with relatively greater polarity such as a polyvinyl butyral resin, an epoxy resin or a polyester resin is used in the adhesion layer, adhesive force with the support may be strengthened but the adhesive force with the colorant layer is weak, whereby film peel-off will readily occur at the interface between the colorant layer and the adhesion layer to make it difficult to obtain printing for multiple times. Particularly, this tendency becomes marked when the applied power is increased or an additive such as a surfactant, etc. is incorporated in the colorant layer. This film peel-off is liable to occur at the edge portion of the printed pattern, with the result that the so called white drop-out portion will be formed in the second printed pattern to give a very unclear letter.

SUMMARY OF THE INVENTION

A technical task of the present invention is to provide a thermal transfer recording medium which can consolidate the adhesive force between the support and the colorant layer and prevent film peel-off of the colorant layer, particularly capable of obtaining good pattern printing without the above film peel-off for a large number of times even when applied power may be increased or an additive such as a surfactant, etc. may be incorporated.

The present inventor has continued intensive studies and consequently found that the above technical task can be solved to accomplish the object of the present invention in a thermal transfer recording medium having a heat-fusible colorant layer through an intermediary adhesion layer on a support by incorporating at least one compound selected from the group A shown below and at least one compound selected from the group B shown below in said adhesion layer:

(group A)

polyurethane resins, phenoxy resins, polyester resins and polycarbonate resins;

(group B)

vinyl acetate copolymers and acrylate copolymers.

DETAILED DESCRIPTION OF THE INVENTION

Figure 1:
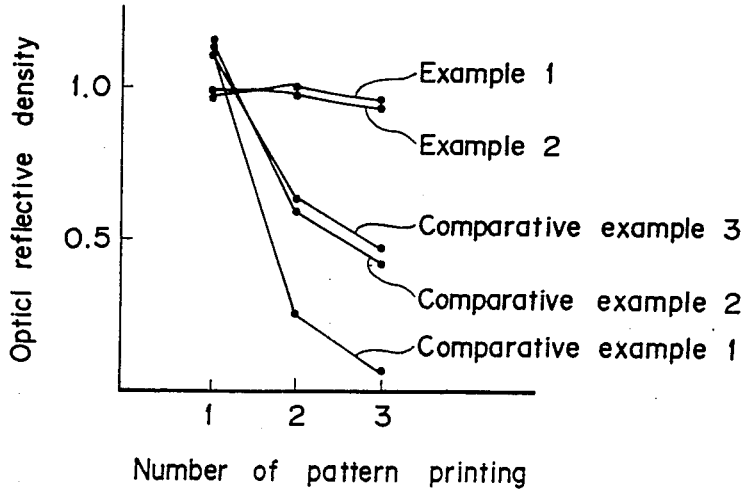
FIGS. 1 to 4 are graphs showing the relationships between the number of pattern printing and the optical reflective density in Examples and Comparative examples, the axis of abscissa indicating number of pattern printing and the axis of ordinate optical reflective density.

The thermal transfer recording medium of the present invention has an adhesion layer formed on a support, and further one layer or two or more layers of heat-fusible colorant layer formed on the adhesion layer. When two or more colorant layers are formed, intermediate layers may also be provided between the respective colorant layers.

In the present invention, the adhesion layer contains at least one compound selected from the above group A, namely polyurethane resins, phenoxy resins, polyester resins and polycarbonate resins and at least one compound selected from the above group B, namely vinyl acetate copolymers and/or acrylate copolymers in combination.

The polyurethane resin to be used in the present invention can be obtained from the reaction of a polyfunctional isocyanate with an active hydrogen compound with high molecular weight or low molecular weight having two or more active hydrogens in one molecule alone or as a mixture of both.

Examples of the polyfunctional isocyanate may be compounds having two or more isocynate groups in one molecule, such as tolyrene diisocyanate, 4,4'-methylenediphenyl diisocyanate (MDI), xylylene diisocyanate (XDI), 1,6-hexamethylene diisocyanate (HMDI), tolidine diisocyanate, isophorone diisocyanate, hydrogenated 4,4'-methylenediphenyl diisocyanate, or compositions, dimers, trimers or carbodiimide modified products of these compounds.

Examples of the compounds having two or more active hydrogens in one molecule may include:

(1) polyester polyols having hydroxyl groups at terminal ends obtained from the reaction of polyhydric alcohols such as ethylene glycol, propylene glycol, diethylene glycol, trimethylolpropane, etc. with polybasic acids such as malonic acid, succinic acid, adipic acid, azelaic acid, phthalic acid, etc.;

(2) low molecular weight polyols such as ethylene glycol, propylene glycol, 1,4-butanediol, 1,3-butanediol, 1,5-pentanediol, 1,6-hexanediol, 1,2,6-hexanetriol, trimethylolpropane, 1,4-cyclohexanedimethanol, etc.;

(3) polyether polyols obtained by addition of ethylene oxide or propylene oxide to polyhydric alcohols such as ethylene glycol, propylene glycol, 1,4-butanediol, glycerine, trimethylolpropane, pentaerythritol, sorbitol, bisphenol A, etc.;

(4) polyesters having a terminal OH group obtained from the above (3) and the above polybasic acids;

(5) hydroxyl containing compounds such as polybutadiene glycol, polyisoprene glycol, lactone ring-opened polymers, tetrahydrofuran ring-opened polymers, castor oil; and so on. Particularly, those having an average molecular weight per active hydrogen of 30 to 10,000 are preferred, and they can be used either individually or as a mixture.

The polyurethane resin may also have an active hydrogen compound or a reactive substituent such as isocyanate group or acryloyl group at the terminal end, or the terminal end may also be an inert substituent. When the resin has an active hydrogen compound or a reactive substituent at its terminal end, it may also be cured with an appropriate curing agent.

The polyurethane resin may also be available as commercial products, as exemplifeid by "N-2301", "N-2304", "N-3022" produced by Nippon Polyurethane Co., "MAU-9022" produced by Dainippon Seika Co., "Estane 5701 FI", "Estane 5703", produced by Goodrich Co., etc. The polyurethane resin should have as the preferable physical property a softening point (value measured by the ring and ball method according to JIS K 2207) of 40° C. to 200° C., more preferably 60° C. to 200° C. Its weight average molecular weight may preferably be 200 to 500,000, more preferably 10,000 to 300,000.

The phenoxy resin to be used in the present invention can be obtained from the reaction of epichlorohydrin with bisphenol A. Since the phenoxy resin contains active hydrogens in the molecule, it can also be cross-linked with an isocyanate, an acid anhydride, triazine, melamine, etc.

The phenoxy resin is also available as commercial products, as exemplified by "PKHH" produced by Union Carbide Co., "YP-50", "YP-60" produced by Toto Kasei Co., etc.

The phenoxy resin should have as the preferable physical property a softening point (value measured by the ring and ball method according to JIS K 2207) of 40° C. to 200° C., more preferably 60° C. to 200° C. Its weight average molecular weight may preferably be 800 to 500,000, more preferably 1,000 to 100,000.

The polyester resin to be used in the present invention is polymeric compounds having ester linkages on the main chain thereof, which can be obtained by the polycondensation of a dicarboxylic acid or a halide thereof with a diol, the polycondensation of an oxyacid or the ring-opening polymerization of a lactone.

The dicarboxylic acids include, for example, aliphatic dicarboxylic acids such as oxalic acid, malonic acid, succinic acid, glutaric acid, adipinic acid, pimelic acid, maleic acid, fumalic acid, itaconic acid, etc., and aromatic dicarboxylic acids such as phthalic acid, tetrachlorophthalic acid, isophthalic acid, terephthalic acid, etc. The diols include, for example, aliphatic diols such as ethylene glycol, propylene glycol, 1,4-butanediol, 1,3-butanediol, 1,5-pentanediol, 1,6-hexanediol, 1,4-cyclohexanedimethanol, diethylene glycol, etc. and aromatic diols such as hydroquinone, bisphenol A, etc. The oxyacids include, for example, glycolic acid, hydroacrylic acid, 1-oxypentanonic acid, 1-oxyhexanoic acid, 1-oxyheptanoic acid, salicylic acid, oxybenzoic acid, etc. The lactones include, for example, $\epsilon$-caprolactone, $\beta$-propiolactone, dimethylpropiolactone, etc.

The polyester resin should have as the preferable physical property a softening point (value measured by the ring and ball method according to JIS K 2207) of 40° C. to 200° C. When the polyester resin is a saturated polyester resin, its weight average molecular weight may preferably be 8,000 to 100,000, more preferably 10,000 to 60,000, and when the resin is an unsaturated polyester resin, its molecular weight may preferably be 100 to 10,000, more preferably 500 to 8,000. Although either saturated polyester resins or unsaturated polyester resins may be used in the present invention, saturated polyester resins are preferred. When unsaturated polyester resins are used, they may also be cured by heating or with an appropriate curing agent.

The polyester resins in the present invention may also be available as commercial products, as exemplified by "Polyester LP-033", "Polyester LP-035", "Polyester SP-170", "Polyester TP-220" produced by Nippon Goseikagaku Co., "Bylon-200", "Bylon-300" produced by Toyobo Co., etc.

The polycarbonate resin to be used in the present invention can be obtained by the reaction of a diol with phosgene or the ester exchange reaction of a diol with a diaryl carbonate.

The diols include, for example, hydroquinone, bisphenol A, ethylene glycol dihydroquinone ether, etc.

The polycarbonate resin should have as the preferable physical property a softening point (value measured by the ring and ball method according to JIS K 2207) of 60° C. to 250° C. It weight average molecular weight may preferably be 800 to 500,000, more preferably 10,000 to 300,000.

The polycarbonate resin to be used in the present invention may also be available as commercial products, as exemplified by "Panlight L-1250", "Panlight K-1300" produced by Teijin Kasei Co., etc.

The vinyl acetate copolymer to be used in the present invention means a copolymer obtained by copolymerization of vinyl acetate monomer with other vinyl monomers. Other vinyl monomers may include, for example, ethylene, vinyl chloride, vinyl stearate, vinyl ethyl ether, N-vinylpyrrolidone, acrylamide, methyl acrylate, acrylonitrile, methyl methacrylate, styrene, crotonic acid, maleic anhydride, acrylic acid, methacrylic acid, etc. Among them, ethylene and vinyl chloride are preferred. As the compositional ratio of the copolymer, vinyl acetate should preferbly be contained in an amount of 5% by weight or more, more preferably from 10% to 60% by weight. A part of the vinyl acetate moiety may also be saponified to be converted to a vinyl ether, or may also contain other substituents introduced therein.

The vinyl acetate copolymer should have as the preferable physical property a softening point (value measured by the ring and ball method according to ASTM D 1525) of 35° C. to 120° C.

The vinyl acetate copolymer may also be avaialble as commercial products, as exemplified by "NUC-3145", "NUC-3460", "NUC-3160", "NUC-3185" produced by Nippon Unicar Co., "VAGH", "VAGX", "VMCX" produced by Union Carbide Co. and the like.

The acrylate copolymer to be used in the present invention means a copolymer obtained by copolymerization reaction of an acrylate monomer with other monomers.

The acrylate monomer may include, for example, methyl acrylate, ethyl acrylate, propyl acrylate, butyl acrylate, 2-ethylhexylacrylate, cyclohexyl acrylate, aryl acrylate, benzyl acrylate, etc. Among them, ethyl acrylate and butyl acrylate are particularly preferred.

Other monomers to be copolymerized may be, for example, ethylene, vinyl chloride, vinyl stearate, vinyl ethyl ether, N-vinylpyrrolidone, acrylamide, methyl acrylate, acrylonitrile, methyl methacrylate, styrene, crotonic acid, maleic anhydride, acrylic acid, methacrylic acid, etc. Among them, ethylene and vinyl chloride are preferred. As the compositional ratio of the copolymer, the acrylate monomer should be contained in an amount of 5% by weight or more, more preferably from 10% to 60% by weight.

The acrylate copolymer should have as the preferable physical property a softening point (value measured by the ring and ball method according to ASTM D 1525) of 35° C. to 120° C.

The acrylate copolymer is also available as commercial products, as exemplified by "DPDJ-9169", "NUC'6107", "NUC-6070" produced by Nippon Unicar Co.

The mixing ratio of the group (A) resins and the group (B) copolymers is not limited, but the resins of the group (A) may be contained in an amount preferably of 5 to 80% by weight, more preferably 10 to 60% by weight based on the total amount of the resin of the group (A) and the copolymer of the group (B). On the other hand, the compound of the group may be contained in an amount preferably of 95 to 20% by weight, more preferably 90 to 40% by weight. In the sense to make the adhesive force with the support particularly strong when the applied power is increased or an additive such as a surfactant, etc. is added, the compounds of the group (A) may preferably be contained in an amount of 5% by weight or more. On the other hand, in the sense to make the adhesive force between the adhesion layer and the heat-fusible colorant layer more sufficient, the compounds of the group B may be contained in an amount of 20% by weight or more.

In the adhesion layer of the present invention, polymers not belonging to either one of the above groups (A) and (B), may also be contained within the range which does not impair the effect of the present invention. Other additives such as surfactants, etc. may also be added in appropriate amounts.

Further, it is preferable that the adhesion layer of the present invention contains at least one compound selected from higher fatty acids, higher alcohols, fats and waxes.

The higher fatty acids include, for example, palmitic acid, stearic acid, margaric acid, behenic acid, etc.; the higher alcohols include, for example, palmityl alcohol, stearyl alcohol, behenyl alcohol, margaryl alcohol, myricyl alcohol, eicosanol, etc.; the fats include, for example, a natural fat (palm oil, lard, tallow, mutton tallow, etc.), cetyl palmitate, myrisyl palmitate, cetyl stearate and myrisyl stearate; and the waxes include, for example, vegetable waxes such as carnauba wax, wood wax, auricuri wax, espalt wax, etc.; animal waxes such as beeswax, insect wax, shellac wax, whale wax, etc.; petroleum waxes such as paraffin wax, microcrystalline wax, ester wax, oxidized wax, etc.; mineral waxes such as montan wax, ozocerite, ceresin, etc.; and a synthetic wax such as α-olefin-maleic anhydride copolymer, etc.

As the method for forming the adhesion layer of the present invention on a support, there may be employed the hot melt coating method, the solvent coating method, while as the coating method, there may be employed the reverse roll coater method, the extrusion coater method, the gravure coater method and the wire bar method. The adhesion layer formed according to the above method may have a thickness preferably of 0.1 to 3 μm, more preferably of 0.3 to 1 μm.

As the heat-fusible colorant layer to be provided by coating on the adhesion layer of the present invention, various fusible colorant layers may be used without any specific limitation, but the heat-fusible colorant layers preferably employed are to be described below.

The heat-fusible substance to be used in the heat-fusible colorant layer in the present invention is a substance which is solid at normal temperature and can be changed reversibly to a liquid phase, as exemplified specifically by waxes including vegetable waxes such as carnauba wax, wood wax, auricuri wax, espalt wax, etc.; animal waxes such as beeswax, insect wax, shellac wax, whale wax, etc.; petroleum waxes such as paraffin wax, microcrystalline wax, ester wax, oxidized wax, etc.; mineral waxes such as montan wax, ozocerite, ceresin, etc.; and otherwise higher fatty acids such as palmitic acid, stearic acid, margaric acid, behenic acid, etc.; higher alcohols such as palmityl alcohol, stearyl alcohol, behenyl alcohol, myrisyl alochol, eicosanol, etc.; higher fatty acid esters such as cetyl palmitate, myrisyl palmitate, cetyl stearate, myrisyl stearate, etc.; amides such as aceamide, propionic acid amide, palmitic acid amide, stearic acid amide, amide wax, etc. These may be used either singly or in combination. Among them, higher amides such as palmitic acid amide, stearic acid amide, oleic acid amide, amide wax, etc. are particularly preferred. Also, "heat-fusible solid component which is solid at normal temperature" as disclosed in Japanese Unexamined Patent Publication No. 68253/1979 may also be used.

In the present invention, a polymeric compound may be contained in the heat-fusible colorant layer. Any compound may be used without specific limitations as the polymeric compound, provided it has a softening point or a melting point of 60° to 150° C. and can improve the film forming property of the heat-fusible colorant layer.

Specific examples of the polymeric compound to be used preferably in the present invention may include polybutadiene, polystyrene, neoprene, nitrile rubber, polymethyl methacrylate, polyethyl acrylate, polyvinyl acetate, polyvinyl chloride, polymethyl chloroacrylate, ethyl cellulose, nitrocellulose, polyethyleneterephthalate, polymethacrylonirile, cellulose acetate, polyvinylidene chloride, nylon-6, nylon-6,6, plyacrylonitrile, polycarbonate, polyamide, ethylene-ethyl acrylate copolymer, ethylene-vinyl acetate copolymer, polyethylene, polypropylene, petroleum resin, polyvinyl alcohol, polyacetal, fluorine type resin, silicon type resin, natural rubber, chlorinated rubber, olefin rubber, phenol resin, urea resin, melamine resin, polyimide, etc. These may be used either singly or in the form of a mixture (polymer blend) of plural polymers. Preferably, polybutadiene, ethylene-ethyl acrylate copolymer, ethylene-vinyl acetate copolymer, polyethylene, polypropylene, petroleum resin may be employed, particularly preferably ethylene-vinyl acetate copolymer, ethylene-ethyl acrylate copolymer and petroleum resin. Among them, one or a combination of two or more polymers may preferably be used.

The heat-fusible colorant layer of the present invention may contain a surfactant. As the surfactant, any of nonionic surfactants, cationic surfactants, anionic surfactants and amphoteric surfactants may be available. For examle, there may be employed nonionic surfactants such as polyethylene glycol, polyethylene glycol monoester, polyethylene glycol diester, polyoxyethylene sorbitane ester, polyoxyethylene alkyl ether, polyoxyethylene nonylphenyl ether, polyglycerine ester, etc.; cationic surfactants such as octadecylamine acetate, alkyltrimethylammonium chloride, polyoxyethylene octadecylamine, polyoxyethylene alkylamine, polymeric amine, etc.; anionic surfactants such as fatty acid soda soap, fatty acid potash soap, stearic acid soap, alkyl ether sulfate (Na salt), sperm whale alcohol, sulfate ester sodium salt, sodium dodecylbenzenesulfonate, sodium n-dodecylbenzenesulfonate (soft type), sodium alkylmethyltaurate, sodium oleoylmethyltaurate, sodium dioctylsulfosuccinate, polymer type anion (polycarboxylic acid type), etc.; amphoteric surfactants such as hydroxyethylimidazoline sulfate, imidazolinesulfonic acid, alkylamino acid, etc.

The colorant to be used in the heat-fusible colorant layer of the present invention may be selected from various colorants, preferably from among direct dyes, acidic dyes, basic dyes, disperse dyes, oil-soluble dyes (including metal containing oil-soluble dyes), etc. Since the colorant to be used in the colorant layer of the present invention may be a colorant which can be transferred (migrated) together with the heat-fusible substance, a pigment may also be used, other than those as mentioend above. Specific examles are as mentioned below. That is, as the yellow pigment, there may preferably be employed Kayaron Polyester Light Yellow 5G-S (Nippon Kayaku), Oil Yellow S-7 (Hakudo), Eisen Spiron Yellow GRH Special (Hodogaya), Sumiplast Yellow FG (Sumitomo), Eisen Spiron Yellow GRH (Hodogaya), etc. As the red colorant, there may preferably be employed Diaseritone Fast Red R (Mitsubishi Kasei), Dianix Brilliant Red BS-E (Mitsubishi Kasei), Sumiplast Red FB (Sumitomo), Sumiplast Red HFG (Sumitomo), Kayaron Polyester Pink RCL-E (Nippon Kayaku), Eisen Spiron Red GEH Special (Hodogaya), etc. As the blue colorant, there may preferably be employed Diaseritone Fast Brilliant Blue R (Mitsubishi Kasei), Dianix Blue EB-E (Mitsubishi Kasei), Kayaron Polyester Blue B-SF Conc. (Nippon Kayaku), Sumiplast Blue 3R (Sumitomo), Sumiplast Blue G (Sumitomo), etc. Also, as the yellow pigment, Hanza Yellow 3G, Tartrazine Lake, etc. may be employed; as the red pigment, Brilliant Carmine FB-Pure (Sanyo Shikiso), Brilliant Carmine 6B (Sanyo Shikiso), Alizarine Lake, etc.; as the blue pigment, Cerlean Blue, Sumica Print Cyanine Blue GN-0 (Sumitomo), Phthalocyanine Blue, etc.; and as the black pigment, Carbon Black, Oil Black, etc.

The compositional ratio of the heat-fusible colorant layer of the present invention is not limitative, but may preferably be 30 to 95 parts (more preferably 40 to 90 parts) for the heat-meltable substance, 5 to 40 parts (more preferably 10 to 35 parts) for the colorant, 0 to 30 parts (more preferbly 4 to 20 parts) for the polymeric compound, 0 to 60 parts for the surfactant (more preferably 5 to 50 parts) per 100 parts of the total solid content of the heat-fusible colorant layer (parts are parts by weight, hereinafter the same).

The heat-fusible colorant layer, in addition to the above components, may also contain various additives. For example, vegetable oils such as castor oil, linseed oil, olive oil, animal oils such as whale oil and mineral oils may preferably be employed.

In the present invention, it is particularly effective to incorporate a polyethyleneglycol diester of the above surfactants in the heat-fusible colorant layer. In this case, it is more effective to use at least one heat-fusible substance selected from the group of waxes as shown below in combination. In the following, this preferred embodiment is to be explained.

The polyethyleneglycol diester has fatty acids bonded through ester linkage at both terminal ends of a polyethyleneglycol, which should preferably be solid or paste-like at normal temperature (25° C.), more preferably, has a melting point of 40° to 100° C., particularly 45° to 80° C., from the viewpoints of antiblocking property and sensitivity.

The group of wax compounds to be used in the present invention may include waxes which are solid at normal temperature, preferably having melting points of 40° to 80° C. (as measured value by Yanagimoto MPJ-2 Model), as exemplified specifically below.

The animal waxes may include beeswax, insect wax, shellac wax, whale wax, wool wax, etc.; the vegetable waxes carnauba wax, wood wax, auricuri wax, espalt wax, candelilla wax, etc.; mineral waxes montan wax, ozocerite, ceresin, etc.; petroleum waxes paraffin wax, microcrystalline wax, ester wax, petrolatum, etc.; synthetic hydrocarbon waxes Fischer-Tropsch wax, polyethylene wax, low molecular weight polypropylene, low molecular weight polyethylene and derivatives thereof, etc.; modified waxes oxidized wax, montan wax derivatives, paraffin or microwax derivatives; and so on. These may be used either singly or as a combination of two or more waxes.

The polyethylene glycol diester to be used in the present invention may have a molecular weight (weight average molecular weight, hereinafter the same), which may differ depending on the composition of the wax and the properties of the compound, but preferably of 400 to 20,000, more preferably 6,000 to 18,000, with the molecular weight of the intramolecular ethylene oxide moiety being preferably 70 to 20,000, particularly 4,000 to 16,000, from viewpoints of antiblocking property and printing characteristics.

Also, the diester moiety, as compared with the case of a polyethylene glycol ester or a mere polyethylene glycol, improves miscibility with the above heat-fusible substance, or when carbon black is contained in the heat-fusible colorant layer, exhibits the effect of not deteriorating its dispersibility, and further in the case of repeated transfer with stably high density or using a paper with low surface smoothness as the paper to be transferred thereon, exhibits the effect of giving a high printed letter quality.

The diester moiety may vary in relation to the molecular weight of the ethylene oxide moiety, but may be represented generally by the following formula:

$$R_1-\overset{\overset{\displaystyle O}{\|}}{C}-O-(CH_2-CH_2-O)_n-\overset{\overset{\displaystyle O}{\|}}{C}-R_2$$

wherein $R_1$ and $R_2$ may be either identical or differnt and each represent a saturated or unsaturated hydrocarbon group or a saturated or unsaturated hydrocarbon containing group (including aromatic groups), and n is an integer of 1 or more, preferably 2 to 450.

Representative examples of the diester moiety may include those derived from fatty acids, namely those derived from palmitic acid, margaric acid, stearic acid, arachic acid, behenic acid, lignoceric acid, montanic acid, merysic acid, palmitoleic acid, petrocenic acid, oleic acid, erucic acid, selacholeic acid, di-, tri-, tetraenic acid, etc.

In the above formula, preferable $R_1$ and $R_2$ may include saturated or unsaturated hydrocarbons derived from fatty acids, more preferably hydrocarbons having 10 to 50 carbon atoms. Also, although different depending on the molecular weight of the ethyleneoxide moiety, stickiness is generated when the carbon number is too small to worsen antiblockng property, while the melting point is increased so high as to make sensitivity lower when the carbon number is too large. Hence, these groups should particularly preferably have 15 to 30 carbon atoms.

The compositional ratio of the heat-fusible colorant layer of the present invention in such a preferred embodiment is not limitative, but may preferably be 5 to 80 parts (more preferably 10 to 70 parts) for the heatfusible substance, 5 to 50 parts (more preferably 10 to 30 parts) for the colorant, 3 to 80 parts (more preferably 5 to 50 parts) for the polyethylene glycol diester and 0 to 20 parts (more preferably 5 to 15 parts) for the polymeric compound.

The heat-fusible colorant layer may be provided by coating on the adhesion layer similarly as in provision of the above adhesion layer, and its thickness may preferably be 3 to 50 μm, more preferably 5 to 20 μm. In the case of a multi-layer constitution, the thickness of the colorant layer may be a thickenss corresponding to one thermal transfer or a thicknes capable of multiple transfer.

The support to be used in the thermal transfer recording medium of the present invention should desirably have a heat-resistant strength as well as high dimensional stability and surface smoothness. Any of the materials may be suitably used, for example, papers such as plain paper, condenser paper, laminated paper, coated paper, etc., resin films such as polyethylene, polyethyleneterephthalate, polystyrene, polypropylene, polyimide, etc., paper-resin film composite, metal sheet such as aluminum foil, etc. The support may have a thickness generally of about 60 μm or less for obtaining good thermal conductivity, preferably in the range from 1 to 25 μm, more preferably from 1.5 to 15 μm, particularly preferably from 1.5 to 8 μm. Further, the thermal transfer recording medium of the present invention may also have a overcoat layer (e.g. a protective layer), and the backside of the support may be constructed as desired and may also be provided with a backing layer such as a sticking preventive layer, etc.

The present invention is described by referring to the following Examples, by which the present invention is not limited at all. "Parts" used hereinafter indicate "parts by weight".

EXAMPLE

EXAMPLE 1

The following composition A was applied by means of a wire bar on a polyethyleneterephthalate film with a thickness of 3.5 μm, and dried under air stream at 80° C. Thus, an adhesion layer with a dried film thickness of 0.7 μm was obtained.

| Composition A | |
|---|---|
| Polyurethane resin (N-2301, produced by Nippon Polyurethane Co.) | 0.7 part |
| Ethylene-vinyl acetate copolymer (NUC 3185, produced by Nippon Unicar Co.) | 3.3 parts |
| Tetrahydrofuran | 20 parts |
| Cyclohexanone | 48 parts |
| Xylene | 28 parts |

Next, the following composition B was dispersed by means of a sand grinder at 110° C. for 4 hours.

| Composition B | |
|---|---|
| Carbon black | 13 parts |
| Diacaruna 30 | 20 parts |
| Polyethylene wax (Weissen 0252C, produced by Nippon Seiro Co.) | 10 parts |
| Carnauba wax | 17 parts |
| Paraffin wax (SP 0145, produced by Nippon Seiro Co.) | 30 parts |
| Ethylene-vinyl acetate copolymer (NUC 3160, produced by Nippon Unicar Co.) | 10 parts |

The dispersion was subjected to hot melt coating by a wire bar on the above adhesion layer to obtain a thermal transrer recording medium of the present invention having a heat-fusible colorant layer with a film thickness of 8.0 μm.

By use of this medium, solid black pattern printing was performed by a serial type thermal printer, while giving an energy of 0.9 mj/dot. After printing once, registration of the thermal head was done so that the same portion of the recording medium might be used, and repeated printing was then conducted three times. Printing was performed by using a high quality paper with Bekk smoothness of 100 sec as the paper to be transferred thereon.

As a result, pattern printing could be done without peel-off of the film at all, with little lowering in density even after pattern printing repeated three times and yet with high density. The above results are shown in FIG. 1. FIG. 1 is a graph showing the relationship between the number of printing and the optical reflective density, the axis of abscissa indicating number of printing and the axis of ordinate optical reflective density.

EXAMPLE 2

In Example 1, the ethylene-vinyl acetate copolymer in Composition A was replaced with an ethylene-ethyl acrylate copolymer (NUC 6070, produced by Nippon Unicar Co.) to obtain an adhesive layer with a film thickness of 0.7 μm similarly as in Example 1.

On the adhesion layer was performed hot melt coating of the dispersion of Composition B (colorant layer composition) by a wire bar to obtain a thermal transfer recording medium of the present invention having a heat-fusible colorant layer with a thickness of 8.0 μm. By use of this medium, solid black pattern printing was condcuted similarly as in Example 1.

As a result, pattern printing could be done without peel-off of the film at all, with little lowering in density even after pattern printing repeated three times and yet with high density. The above results are shown in FIG. 1.

COMPARATIVE EXAMPLE 1

The following composition C was applied by means of a wire bar on a polyethyleneterephthalate film with a thickness of 3.5 μm, and dried under air stream at 80° C. Thus, an adhesion layer with a dried film thickness of 0.7 μm was obtained.

| Composition C | |
|---|---|
| Ethylene-vinyl acetate copolymer (NUC 3185, produced by Nippon Unicar Co.) | 4 parts |
| Xylene | 96 parts |

On this adhesion layer, the same heat-fusible colorant layer with the same composition as used in Example 1 was provided by coating to a film thickness of 8.0 μm to obtain a thermal transfer recording medium.

By use of this medium, solid black pattern printing was attempted to be performed for a number of times similarly as in Example 1.

Figure 3:
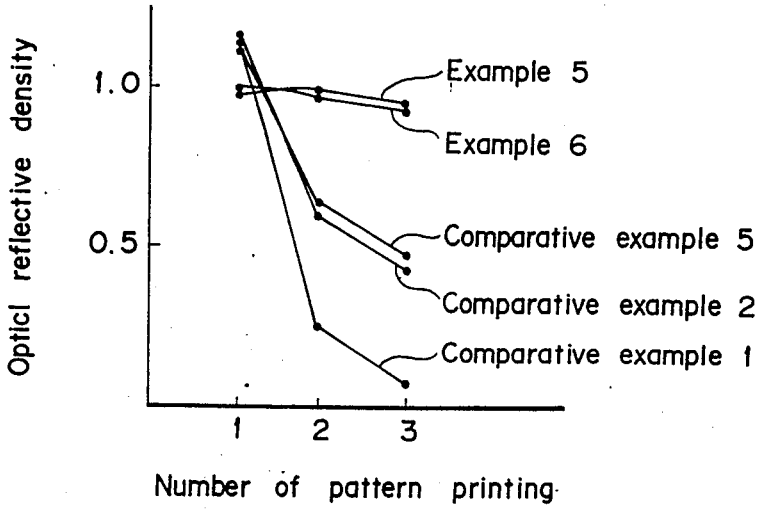

As a result, during the first pattern printing, film peel-off occurred at the peripheral portion of the solid black, until the peeled-off portion was removed to leave a white blank after pattern printing repeated twice, thus failing ultimately to perform a number of pattern printing. The above results are shown in FIG. 1 or 3.

COMPARATIVE EXAMPLE 2

The following composition D was applied by means of a wire bar on a polyethyleneterephthalate film with a thickness of 3.5 μm, and dried under air stream at 80° C. Thus, an adhesion layer with a dried film thickness of 0.7 μm was obtained.

| Composition D | |
|---|---|
| Ethylene-ethyl acrylate copolymer (NUC 6070, produced by Nippon Unicar Co.) | 4 parts |
| Xylene | 96 parts |

On this adhesion layer, the same heat-fusible colorant layer with the same composition as used in Example 1 was provided by coating to a film thickness of 8.0 μm to obtain a thermal transfer recording medium.

By use of this medium, solid black pattern printing was performed for a number of times similarly as in Example 1.

As a result, although a number of pattern printing could be performed, lowering in density occurred as pattern printing was repeated, thus indicating poor performance in pattern printing for plural times. The above results are shown in FIG. 1 or 3.

COMPARATIVE EXAMPLE 3

The following composition E was applied by means of a wire bar on a polyethyleneterephthalate film with a thickness of 3.5 μm, and dried under air stream at 80° C. Thus, an adhesion layer with a dried film thickness of 0.7 μm was obtained.

| Composition E | |
|---|---|
| Polyurethane resin (N-2301, produced by Nippon Polyurethane Co.) | 4 parts |
| Tetrahydrofuran | 96 parts |

On this adhesion layer, the same heat-fusible colorant layer with the same composition as used in Example 1 was provided by coating to a film thickness of 8.0 μm to obtain a thermal transfer recording medium.

By use of this medium, solid black pattern printing was performed for a number of times similarly as in Example 1.

As a result, although a number of pattern printing could be performed, lowering in density occurred as pattern printing was repeated, thus indicating poor performance in pattern printing for plural times. The above results are shown in FIG. 1 or 3.

EXAMPLE 3

In Example 1, the polyurethane resin in Composition A was replaced with a phenoxy resin (PKHH, produced by Nippon Union Carbide Co.) to obtain an adhesion layer with a film thickness of 0.7 μm similarly as in Example 1.

On the adhesion layer was performed hot melt coating of the dispersion prepared similarly as in Example 1 (colorant layer composition) by a wire bar to obtain a thermal transfer recording medium of the present invention having a heat-fusible colorant layer with a thickness of 8.0 μm.

Figure 2:
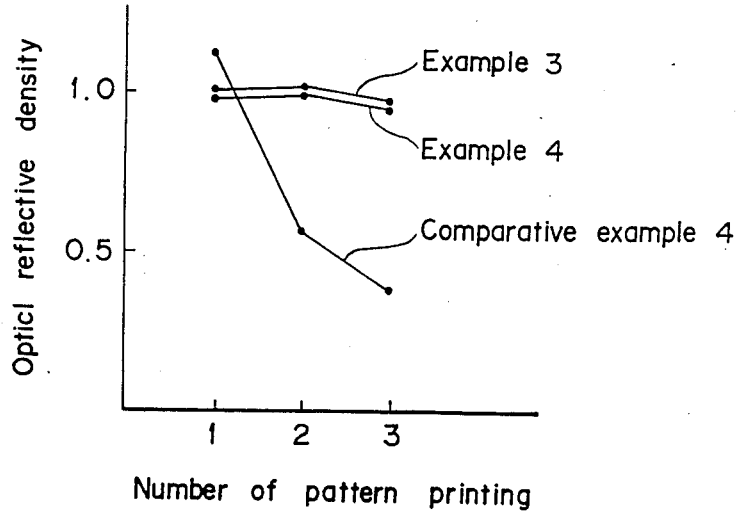

By use of this medium, solid black pattern printing was conducted similarly as in Example 1. As a result, pattern printing could be done without peel-off of the film at all, with little lowering in density even after pattern printing repeated three times and yet with high density. The above results are shown in FIG. 2.

EXAMPLE 4

In Example 2, the polyurethane resin in Composition A was replaced with a phenoxy resin (PKHH, produced by Nippon Union Carbide Co.) to obtain an adhesion layer with a film thickness of 0.7 μm similarly as in Example 2.

On the adhesion layer was performed hot melt coating of the dispersion prepared similarly as in Example 2 (colorant layer composition) by a wire bar to obtain a thermal transfer recording medium of the present invention having a heat-fusible colorant layer with a thickness of 8.0 μm.

By use of this medium, solid black pattern printing was conducted similarly as in Example 3. As a result, pattern printing could be done without peel-off of the film at all, with little lowering in density even after pattern printing repeated three times and yet with high density. The above results are shown in FIG. 2.

COMPARATIVE EXAMPLE 4

In Comparative example 3, the polyurethane resin in Composition E was replaced with a phenoxy resin (PKHH, produced by Union Carbide Co.) to obtain an adhesion layer with a film thickness of 0.7 μm similarly as in

COMPARATIVE EXAMPLE 3

On this adhesion layer, the heat-fusible colorant layer with the same composition as used in Example 3 was provided by coating so as to give a film thickness of 8.0 μm to obtain a thermal transfer recording medium.

By use of this medium, pattern printing was performed for a number of times. As a result, although a number of pattern printing could be performed, but lowering in density occurred as pattern printing was repeated, thus indicating poor performace in pattern printing for plural times. The above results are shown in FIG. 2.

EXAMPLE 5

The following composition F was applied by means of a wire bar on a polyethyleneterephthalate film with a thickness of 3.5 μm, and dried under air stream at 80° C. Thus, an adhesion layer with a dried film thickness of 0.7 μm was obtained.

| Composition F | |
|---|---|
| Polyester resin (Polyester LP-033, produced by Nippon Goseikagaku Co.) | 0.7 part |
| Ethylene-vinyl acetate copolymer | 3.3 parts |

-continued

| Composition F | |
|---|---|
| (NUC 3185, produced by Nippon Unicar Co.) | |
| Tetrahydrofuran | 20 parts |
| Cyclohexanone | 48 parts |
| Xylene | 28 parts |

Next, the following composition G was dispersed by means of a sand grinder at 110° C. for 4 hours.

| Composition G | |
|---|---|
| Carbon black | 13 parts |
| Diacaruna 30 | 20 parts |
| Polyethylene wax | 10 parts |
| (Weissen 0252C, produced by Nippon Seiro Co.) | |
| Carnauba wax | 17 parts |
| Paraffin wax | 30 parts |
| (SP 0145, produced by Nippon Seiro Co.) | |
| Ethylene-vinyl acetate copolymer | 10 parts |
| (NUC 3160, produced by Nippon Unicar Co.) | |

The dispersion was subjected to hot melt coating by a wire bar on the above adhesion layer to obtain a thermal transfer recording medium of the present invention having a heat-fusible colorant layer with a film thickness of 8.0 μm.

By use of this medium, solid black pattern printing was performed by a serial type thermal printer, while giving an energy of 0.9 mj/dot. After printing once, registration of the thermal head was done so that the same portion of the recording medium might be used, and repeated printing was then conducted three times. Printing was performed by using a high quality paper with Bekk smoothness of 100 sec as the paper to be transferred thereon.

As a result, pattern printing could be done without peel-off of the film at all, with little lowering in density even after pattern printing repeated three times and yet with high density. The above results are shown in FIG. 3. FIG. 3 is a graph showing the relationship between the number of printing and the optical reflective density, the axis of abscissa indicating number of printing and the axis of ordinate optical reflective density.

EXAMPLE 6

In Example 5, the ethylene-vinyl acetate copolymer in Composition F was replaced with an ethylene-ethyl acrylate copolymer (NUC 6070, produced by Nippon Unicar Co.) to obtain an adhesive layer with a film thickness of 0.7 μm similarly as in Example 5.

On the adhesion layer was performed hot melt coating of the dispersion of Composition G (colorant layer composition) by a wire bar to obtain a thermal transfer recording medium of the present invention having a heat-fusible colorant layer with a thickness of 8.0 μm. By use of this medium, solid black pattern printing was conducted similarly as in Example 5.

As a result, pattern printing could be done without peel-off of the film at all, with little lowering in density even after pattern printing repeated three times and yet with high density. The above results are shown in FIG. 3.

COMPARATIVE EXAMPLE 5

The following composition H was applied by means of a wire bar on a polyethyleneterephthalate film with a thickness of 3.5 μm, and dried under air stream at 80° C. Thus, an adhesion layer with a dried film thickness of 0.7 μm was obtained.

| Composition H | |
|---|---|
| Polyester resins | 4 parts |
| (Polyester-LP-033, produced by Nippon Goseikagaku Co.) | |
| Tetrahydrofuran | 96 parts |

On this adhesion layer, the same heat-fusible colorant layer with the same composition as used in Example 5 was provided by coating to a film thickness of 8.0 μm to obtain a thermal transfer recording medium.

By use of this medium, solid black pattern printing was performed for a number of times similarly as in Example 5.

As a result, although a number of pattern printing could be performed, lowering in density occurred as pattern printing was repeated, thus indicating poor performance in pattern printing for plural times. The above results are shown in FIG. 3.

EXAMPLE 7

Following the same procedure as in Example 5, exept that the polyester resin in Composition F was replaced with a polycarbonate resin (Panlight L-1250, produced by Teijin Kasei Co.) and dichloroethane was used as a solvent, an adhesion layer with a film thickness of 0.7 mμ similarly as in Example 5 was obtained.

On the adhesion layer was performed hot melt coating of the dispersion prepared similarly as in Example 5 (colorant layer composition) by a wire bar to obtain a thermal transfer recording medium of the present invention having a heat-fusible colorant layer with a thickness of 8.0 μm.

Figure 4:
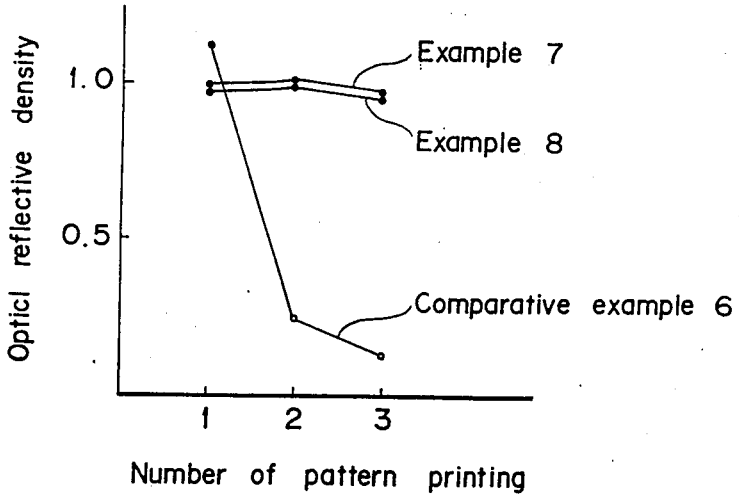

By use of this medium, solid black pattern printing was condcuted similarly as in Example 5. As a result, pattern printing could be done without peel-off of the film at all, with little lowering in density even after pattern printing repeated three times and yet with high density. The above results are shown in FIG. 4.

EXAMPLE 8

Following the same procedure as in Example 6, except that the polyester resin in Composition F was replaced with a polycarbonate resin (Panlight L-1250, produced by Teijin Kasei Co.) and dichloroethane was used as a solvent, an adhesion layer with a film thickness of 0.7 μm similarly as in Example 6 was obtained.

On the adhesion layer was performed hot melt coating of the dispersion prepared similarly as in Example 6 (colorant layer composition) by a wire bar to obtain a thermal transfer recording medium of the present invention having a heat-fusible colorant layer with a thickness of 8.0 μm.

By use of this medium, solid black pattern printing was conducted similarly as in Example 7. As a result, pattern printing could be done without peel-off of the film at all, with little lowering in density even after pattern printing repeated three times and yet with high density. The above results are shown in FIG. 4. Comparative Example 6

In Comparative example 5, the polyester resin in Composition H was replaced with a polycarbonate resin (Panlight L-1250, produced by Teijin Kasei Co.) and dichloroethane was used a solvent to obtain an adhesion layer with a film thickness of 0.7 μm similarly as in comparative example 5.

On this adhesion layer, the heat-fusible colorant layer with the same composition as used in Example 5 was provided by coating so as to give a film thickness of 8.0 mμ to obtain a thermal transfer recording medium.

By use of this medium, pattern printing was performed for a number of times. As a result, although a number of pattern printing could be performed, but lowering in density occurred as pattern printing was repeated, thus indicating poor performance in pattern printing for plural times. The above results are shown in FIG. 4.

EXAMPLE 9

In Examples 1–8, pattern printing was performed similarly by use of the same thermal transfer recording media with the same adhesion layers as in said Examples, except for adding 17 parts of a polyethylene glycol distearate (molecular weight of the ethyleneoxide moiety: 6000) to the heat-fusible colorant layer. As a result, density of printed pattern was increased, and good pattern printing could be effected without film peel-off and yet with little lowering in density.

According to the present invention, adhesive force between the support and the colorant layer can be consolidated and peel-off of the colorant layer can be prevented. Particularly, even when the applied power is increased or an additive such as a surfactant, etc. is incorporated, it is possible to obtain a thermal transfer recording medium capable of performing good pattern printing for a number of times without occurrence of the above film peel-off.

We claim:

1. A thermal transfer recording medium comprising (i) a suppoort, (ii) a heat-fusible colorant layer and (iii) adhesion layer between said support and said colorant layer; said adhesion layer containing at least one resin selected from the group (A) consisting of a polyurethane resin, a phenoxy resin, a polyester resin and a polycarbonate resin, and at least one copolymer selected from the group (B) consisting of a vinyl acetate copolymer and an acrylate copolymer.

2. The thermal transfer recording medium according to claim 1, wherein said resin from the Group (A) is a polyurethane resin obtained by the reaction of a polyfunctional isocyanate with a compound having 2 or more active hydrogens in one molecule; said isocyanate being at least one selected from the group consisting of tolyrene diisocyanate, 4,4'-methylenediphenyl diisocyanate, xylylene diisocyanate, 1,6-hexamethylene diisocyanate, tolidine diisocyanate, isophorone diisocyanate, hydrogenated 4,4'-methylenediphenyl diisocyanate and a mixture, a dimer, a trimer or a carbodiimide modified product of these compounds, and said compound having 2 or more active hydrogens in one molecule being at least one selected from the group consisting of (i) polyester polyols having hydroxyl groups at terminal ends obtained from the reaction of a polyhydric alcohol selected from the group consisting of ethylene glycol, propylene glycol, diethylene glycol and trimethylolpropane, with a polybasic acid selected from the group consisting of malonic acid, succinic acid, adipic acid, azelaic acid and phthalic acid, (ii) a low molecular weight polyol selected from the group consisting of ethylene glycol, propylene glycol, 1,4-butanediol, 1,3-butanediol, 1,5-pentandiol, 1,6-hexanediol, 1,2,6-hexanetriol, trimimethylolpropane and 1α-cyclohexanedimethanol, (iii) a polyether polyol obtained by addition of ethylene oxide or propylene oxide to a polyhydric alcohol selected from the group consisting of ethylene glycol, propylene glycol, 1,4-butanediol, glycerine, trimethylolpropane, pentaerythritol, sorbitol and bisphenol A, (iv) polyesters having a terminal OH group obtained from a polyether polyol obtained by addition of ethylene oxide or propylene oxide to a polyhydric alcohol selected from the group consisting of ethylene glycol, propylene glycol, 1,4-butanediol, glycerine, trimethylolpropane, pentaerythritol, sorbitol and bisphenol A, and a polybasic acid selected from the group consisting of malonic acid, succinic acid, adipic acid, azelaic acid and phthalic acid and (v) a hydroxyl containing compound selected from the group consisting of polybutadiene glycol, polyisoprene glycol, a lactone ring-opened polymer, a tetrahydrofuran ring-opened polymer and castor oil.

3. The thermal transfer recording medium according to claim 1, wherein said resin from the group (A) is a polyurethane resin having a softening point of from 40° C. to 200° C.

4. The thermal transfer recording medium according to claim 1, wherein said resin from the group (A) is a phenoxy resin obtained by the reaction of epichlorohydrin with bisphenol A.

5. The thermal transfer recording medium according to claim 1, wherein said resin from the group (A) is a phenoxy resin having a softening point of from 40° C. to 200° C.

6. The thermal transfer recording medium according to claim 1, wherein said resin from the group (A) is a polyester resin obtained by the polycondensation of a dic:arboxylic acid or a halide thereof with a diol, polycondensation of an oxyacid or the ring-opening polymerization of a lactone; said dicarboxylic acid being selected from the group consisting of oxalic acid, malonic acid, succinic acid, glutaric acid, adipinic acid, pimelic acid, maleic acid, fumalic acid, itaconic acid, phthalic acid, tetrachlorophthalic acid, isophthalic acid and terephthalic acid; said diol being selected from the group consisting of ethylene glycol, propylene glycol, 1,4-butanediol, 1,3-butanediol, 1,5-pentanediol, 1,6-hexanediol, 1,4-cyclohexanedimethanol, diethylene glycol, hydroquinone and bisphenol A; said oxyacid being selected from the group consisting of glycolic acid, hydroacrylic acid, 1-oxypentanonic acid, 1-oxyhexanoic acid, 1-oxyheptanoic acid, salicylic acid and oxybenzoic acid; and said lactone being selected from the group consisting of ε-caproluctone, β-propiolactone and dimethylpropiolactone.

7. The thermal transfer recording medium according to cWClaim 1, wherein said resin from the group (A) is a polyester resin having a softening point of from 40° C. to 200° C.

8. The thermal transfer recording medium according to claim 1, wherein said resin from the group (A) is a polycarbonate resin obtained by the reaction of a diol with phosgene or the ester exchange reaction of a diol with a diaryl carbonate; said diol being selected from the group consisting of hydroquinone, bisphenol A and ethylene glycol dihydroquinone ether.

9. The thermal transfer recording medium according to claim 1, wherein said resin from the group (A) is a polycarbonate resin having a softening point of from 60° C. to 250° C.

10. The thermal transfer recording medium according to claim 1, wherein said copolymer (B) is a vinyl acetate copolymer obtained by copolymerization of a vinyl acetate monomer with a different vinyl monomer selected from the group consisting of ethylene, vinyl chloride, vinyl stearate, vinyl ethyl ether, N-vinylpyrrolidone, acrylamide, methyl acrylate, aorylonitrile, methyl methacrylate, styrene, crotonic acid, maleic anhydride, acrylic acid and methacrylic acid, provided that said vinyl acetate copolymer contains vinyl acetate components in an amount of 5% by weight or more based on the total amount of said vinyl acetate copolymer.

11. The thermal transfer recording medium according to claim 10, wherein said vinyl acetate copolymer contains vinyl acetate components in an amount of 5% by weight or more based on the total amount of said vinyl actate copolymer

12. The thermal transfer recording medium according to claim 1, wherein said copolymer (B) is a vinyl acetate copolymer having a softening point of from 36° C. to 120° C.

13. The thermal transfer recording n:edium according to claim 1, wherein said copolymer (B) is a acrylate copolymer obtained by copolymerization of an acrylate monomer selected from the group consisting of methyl acrylate, ethyl acrylate, propyl acrylate, butyl acrylate, 2-ethylhexylacrate, cyclohexyl acrylate, aryl acrylate and benzyl acrylate, with other monomer selected from the group consisting of ethylene, vinyl chloride, vinyl stearate, vinyl ethyl ether, N-vinylpyrrolidone, acrylamide, methyl acrylate, acrylonitrile, methyl methacrylate, styrene, crotonic acid, maleic anhydride, acrylic acid and methacrylic acid, provided that said acrylate copolymer contains acrylate components in a amount of 5% by weight or more based on the total amount of said acrylate copolymer.

14. The thermal transfer recording medium according to claim 1, wherein said acrylate copolymer contains acrylate components in an amount of 5% by weight or more based on the total amount of said acrylate copolymer.

15. The thermal transfer recording medium according to claim 1, wherein said copolymer (B) is a acrylate copolymer having a softening point of from 35° C. to 120° C.

16. The thermal transfer recording medium according to claim 1, wherein said adhesion layer contains the resin of the group (A) in an amount of from 5% to 80% by weight based on the total amount of the resin of th group (A) and the copolymer of the group (B).

17. The thermal transfer recording medium according to claim 16, wherein said adhesion layer contains the resin of the group (A) in an amount of from 10% to 60% by weight based on the total amount of the resin of the group (A) and the copolymer of the group (B).

18. The thermal transfer recording medium according to claim 17, comprising polyurethane resin and vinyl acetate copolymer.

19. The thermal transfer recording medium according to claim 17, comprising polyurethane resin and ethylene-vinyl acetate copolymer.

20. The thermal transfer recording medium according to claim 17, comprising polyurethane resin and ethylene-ethyl acrylate copolymer.

21. The thermal transfer recording medium according to claim 17, comprising phenoxy resin and ethylene-vinyl acetate copolymer.

22. The thermal transfer recording medium according to claim 17, comprising polyester resin and ethylene-vinyl acetate copolymer.

23. The thermal transfer recording medium according to claim 17, comprising polyester resin and ethylene-ethyl acrylate copolymer.

24. The thermal transfer recording n:edium according to claim 17, comprising polycarbonate resin and ethylene-vinyl acetate copolymer.

25. The thermal transfer recording medium according to claim 17, comprising polycarbonate resin and ethylene-ethyl acrylate copolymer.

26. The thermal transfer recording medium according to claim 1, wherein said adhesion layer has a thickness in the range of from 0.1 to 3 $\mu$m.

27. The thermal transfer recording medium according to claim 1, wherein said adhesion layer further contains at least one compound selected from the group consisting of a higher fatty acid, a higher alcohol, a fat and a wax.

28. The thermal transfer recording medium according to claim 19, wherein said higher fatty acid is selected from the group consisting of palmitic acid, stearic acid, margaric acid, and behenic acid; said higher alcohol, stearyl alcohol, behenyl alcohol, margarino alcohol, myricy alcohol and eicosanol; the fat is selected from the group consisting of palm oil, lard, tallow, cetyl palmitate, myrisyl palmitate, cetyl stearate and myrisyl stearate; and the wax is selected from the group consistng of carnauba wax, wood wax, auricuri wax, espalt wax, beesswax, insect wax, shellac wax, whale wax, paraffin wax, microcrystalline wax, ester wax, oxidized wax, montan wax, ozocerite, ceresin and $\alpha$-olefin-maleic anhydride copolymer.

29. The thermal transfer recording medium according to claim 27, wherein said adhesion layer contains a polyurethane resin , a vinyl acetate copolymer and at least one selected from the group consisting of behenic acid and behenic alcohol.

30. The thermal transfer recording medium according to claim 1, wherein said heat-fusible colorant layer contains a heat-fusible substance in an amount of from 30 to 95 parts by weight, a colorant in an amount of from 5 to 40 parts by weight, a polymeric compound in an amount of from 0 to 30 parts by weight and a surfactant in an amount of from 0 to 60 parts by weight based on 100 parts by weight of the total solid amount in the heat-fusible colorant layer.

31. The thermal transfer recording medium according to claim 30, wherein said surfactant is a polyethylene glycol diester.

32. The thermal transfer recording medium according to claim 1, wherein said support is selected from the group consisting of plain paper, condenser paper, laminated paper, coated paper, polyethylene, polyethylene terephthalate, polystyrene, polypropylene, polyimide and an aluminum foil.

* * * * *